US010041440B2

(12) United States Patent
Di Pietro

(10) Patent No.: US 10,041,440 B2
(45) Date of Patent: Aug. 7, 2018

(54) FUEL INJECTOR INSERT

(71) Applicant: Aaron Di Pietro, Hamilton (CA)

(72) Inventor: Aaron Di Pietro, Hamilton (CA)

( * ) Notice: Subject to any disclaimer, the term of this patent is extended or adjusted under 35 U.S.C. 154(b) by 0 days.

(21) Appl. No.: 15/365,404

(22) Filed: Nov. 30, 2016

(65) Prior Publication Data

US 2017/0159603 A1 Jun. 8, 2017

Related U.S. Application Data

(60) Provisional application No. 62/262,085, filed on Dec. 2, 2015.

(51) Int. Cl.
*F02M 61/14* (2006.01)
*F02F 1/24* (2006.01)

(52) U.S. Cl.
CPC ..... *F02F 1/242* (2013.01); *F02M 61/14* (2013.01)

(58) Field of Classification Search
CPC ..... F02F 1/242; F02M 61/14; F02M 2200/85; F02M 2200/858
USPC ..... 123/470
See application file for complete search history.

(56) References Cited

U.S. PATENT DOCUMENTS 3,334,617 A * 8/1967 Palkowsky ..... F02M 61/14 123/41.31
6,119,658 A * 9/2000 Jehle ..... F02M 61/14 123/41.31
6,155,236 A * 12/2000 Jehle ..... F02M 53/04 123/41.31
6,279,516 B1 * 8/2001 Haugen ..... F02F 1/38 123/41.82 A
7,325,402 B2 * 2/2008 Parker ..... F23D 14/48 239/132
7,484,499 B2 * 2/2009 Beardmore ..... F02M 61/14 123/470
8,230,838 B2 * 7/2012 Clark ..... F02F 1/242 123/470
8,919,324 B2 * 12/2014 Parsons ..... F02M 37/20 123/456
8,960,156 B2 * 2/2015 Martinsson ..... B21D 53/84 123/470
9,309,850 B2 * 4/2016 Akazaki ..... F02M 61/14
9,410,520 B2 * 8/2016 Franks ..... F02M 61/14
9,752,535 B2 * 9/2017 Fern ..... F02M 21/0275
(Continued)

*Primary Examiner* — Hai Huynh
(74) *Attorney, Agent, or Firm* — Merek Blackmon & Voorhees LLC

(57) ABSTRACT

An insert for a cylinder head of an internal combustion engine that has a bore for receiving a fuel injector to deliver fuel through an injector nozzle into a combustion chamber. The insert comprises a generally tubular body having a longitudinally oriented passageway therethrough and receivable within the bore in the cylinder head. The generally tubular body has an inner end and an outer end, with the inner end in proximity to the combustion chamber when said insert is received within the bore. The passageway is tapered such that its diameter increases from the inner end toward the outer end. The longitudinal passageway is dimensioned to sealingly receive the nozzle of the fuel injector when the fuel injector is received within the bore. The insert limits blow-by between the insert and the nozzle of the fuel injector during operation of the internal combustion engine.

7 Claims, 4 Drawing Sheets

(56) References Cited

U.S. PATENT DOCUMENTS

| | | | | |
|---|---|---|---|---|
| 2012/0037124 | A1* | 2/2012 | Peters | F01P 3/16<br>123/470 |
| 2015/0034051 | A1* | 2/2015 | Werger | F02M 53/04<br>123/470 |
| 2015/0252766 | A1* | 9/2015 | Siewert | F02M 61/14<br>123/470 |
| 2016/0138540 | A1* | 5/2016 | Franks | F02M 53/043<br>123/470 |
| 2017/0051713 | A1* | 2/2017 | Peters | F02M 53/046 |

* cited by examiner

FUEL INJECTOR INSERT

FIELD

The present invention relates to inserts for fuel injectors in direct fuel injection internal combustion engines.

BACKGROUND

In a typical direct injection internal combustion engine, a fuel injector delivers fuel to a combustion chamber via an injector nozzle. The injector nozzle is sealed within a bore in the cylinder head, typically with a sealing ring. Over time, it becomes necessary to periodically remove the fuel injector from the cylinder head to clean, repair or replace it.

As the internal combustion engine is used, the injector nozzle of the fuel injector often becomes tightly wedged in the bore in the cylinder head. The injector nozzle may even become "bonded" to the cylinder head over time. Removing the fuel injector from the cylinder head, therefore, becomes problematic. Great force is often required to remove the fuel injector from the cylinder head. The injector nozzle, the sealing ring and/or the bore itself is often damaged in the removal process. In particular, material transfer from cast aluminum cylinder heads onto injector nozzles is a common occurrence, requiring expensive repairs or a cylinder head replacement.

SUMMARY

The invention provides an insert for a cylinder head of an internal combustion engine, the cylinder head including a bore for receiving a fuel injector to deliver fuel through an injector nozzle into a combustion chamber of the engine, the insert comprising: a generally tubular body having a longitudinally oriented passageway therethrough and receivable within the bore in the cylinder head, the generally tubular body having an inner end and an outer end, said inner end in proximity to the combustion chamber when said insert is received within the bore, said passageway tapered such that the diameter of said passageway increases from said inner end toward said outer end, the longitudinal passageway dimensioned to sealingly receive the nozzle of the fuel injector when the fuel injector is received within the bore in the cylinder head, the insert limiting blow-by between the insert and the nozzle of the fuel injector during operation of the internal combustion engine.

Further aspects of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show exemplary embodiments of the present invention in which.

DESCRIPTION

The present invention may be embodied in a number of different forms. The specification and drawings that follow describe and disclose some of the specific forms of the invention.

Figure 2:
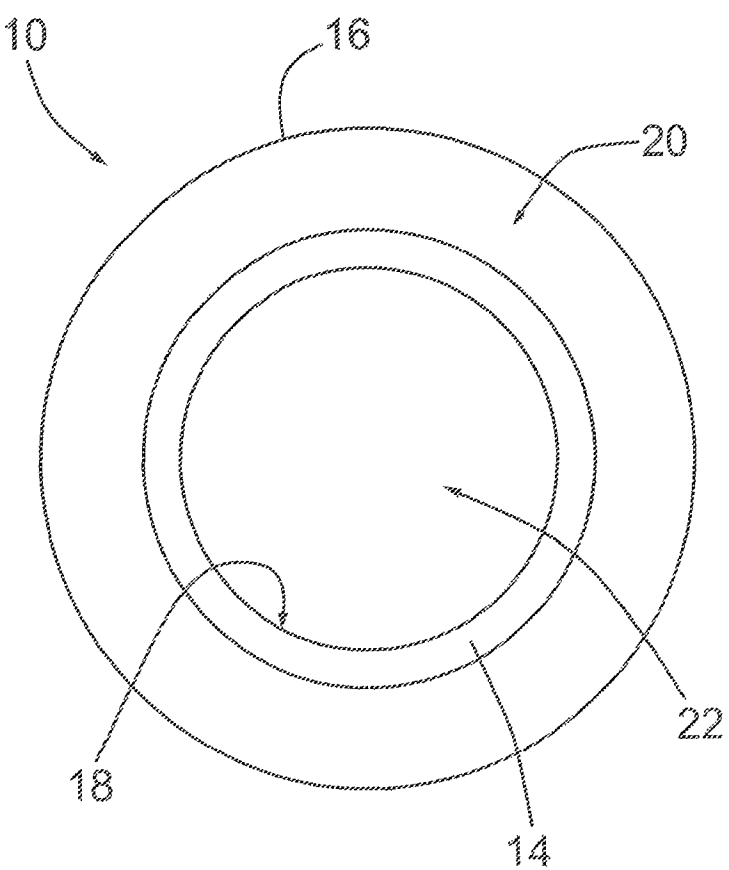
FIG. 2 is an enlarged top view of the insert of FIG. 1.
Figure 1:
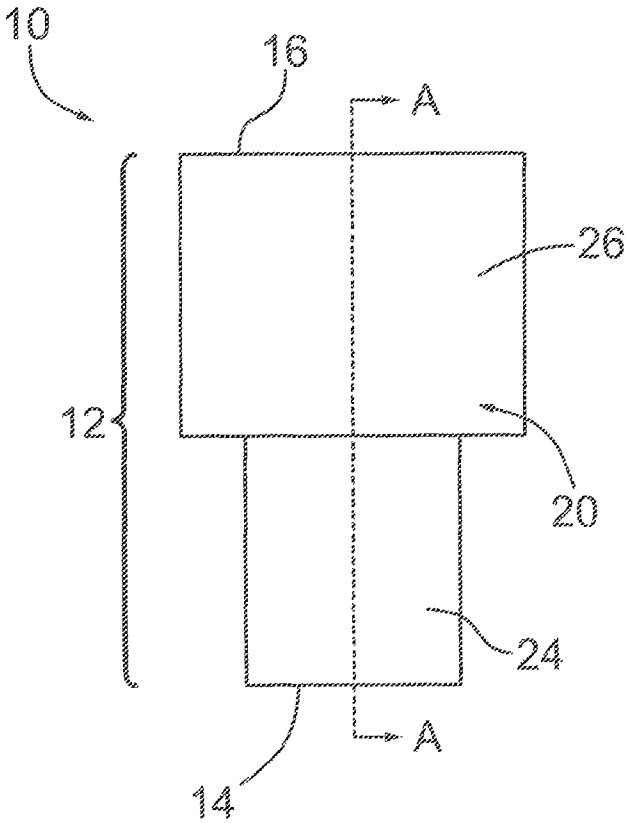
FIG. 1 is a side view of an insert according to an example embodiment of the present invention.

In the attached drawings, an insert constructed in accordance with the present invention is represented generally by reference character 10. As shown in FIGS. 1 and 2, insert 10 comprises a generally tubular body 12 having a longitudinally oriented passageway 22 therethrough. Tubular body 12 has an inner end 14, an outer end 16, an interior surface 18 and an exterior surface 20. Interior surface 18 surrounds longitudinally oriented passageway 22, running between inner end 14 and outer end 16. As best seen in FIG. 2, in this embodiment passageway 22 is circular in cross-section.

Exterior surface 20 is also circular in cross-section in this embodiment, and may include a first portion 24 and a second portion 26. First portion 24 is adjacent to inner end 14, while second portion 26 is adjacent to outer end 16. As seen in FIG. 1, the diameter of exterior surface 20 increases in a step-wise manner such that the diameter of second portion 26 is larger than the diameter of first portion 24.

Figure 3:
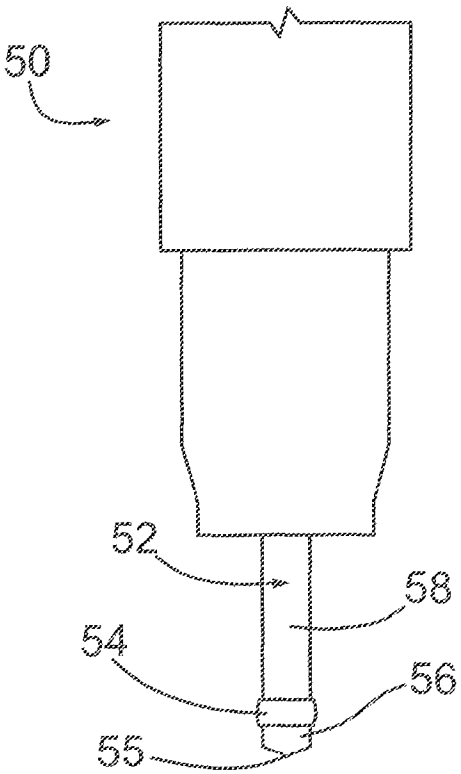
Fig. 3 (PRIOR ART)
FIG. 3 is a side view of an injector nozzle of a conventional fuel injector.

FIG. 3 depicts a portion of a conventional fuel injector 50 with an injector nozzle 52. Injector nozzle 52 includes a circumferential ring or sealing ring 54 situated between a tip portion 56 and a base portion 58. Here, ring 54 is proximate to an injector tip 55.

Figure 4:
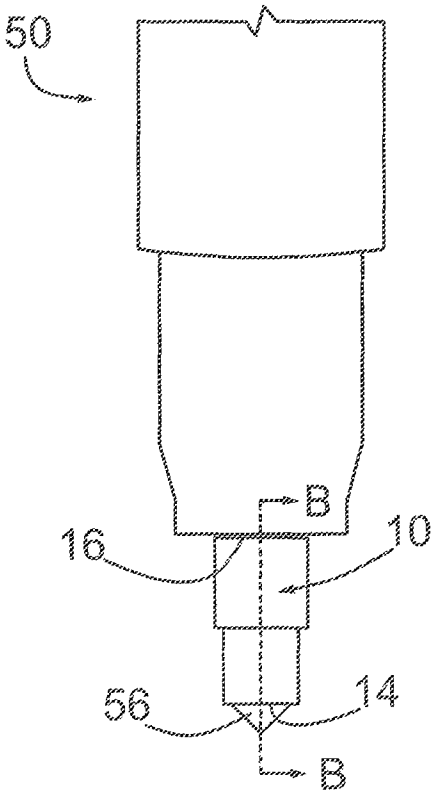
FIG. 4 is a view of the injector nozzle of FIG. 3 with the insert of FIG. 1 received thereon.

As depicted in FIG. 4, when insert 10 is used in association with fuel injector 50, insert 10 is received about the nozzle of the injector with tip portion 56 extending through lower end 14.

Figure 6:
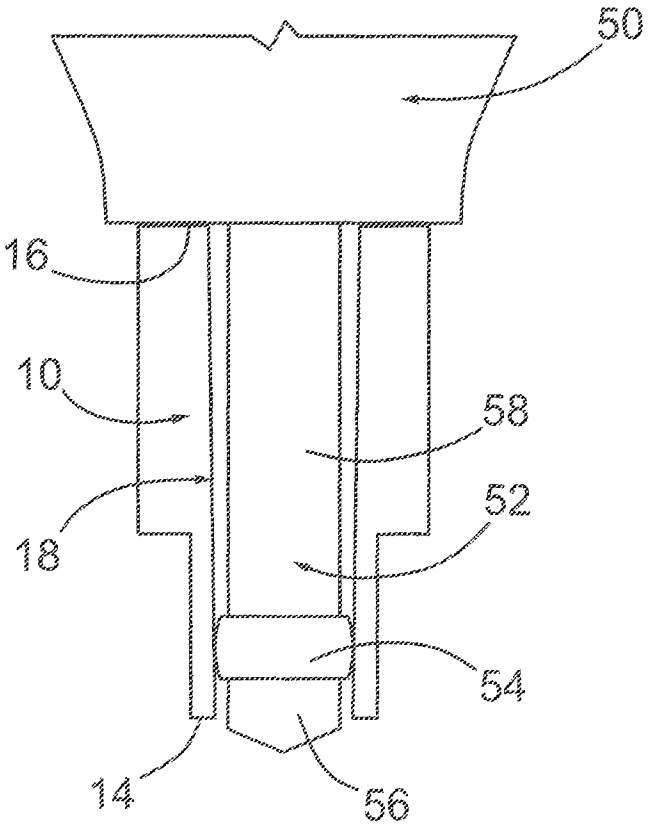
FIG. 6 is an enlarged view of the injector nozzle and a cross sectional view of the insert according to FIG. 4 along line B-B.
Figure 5:
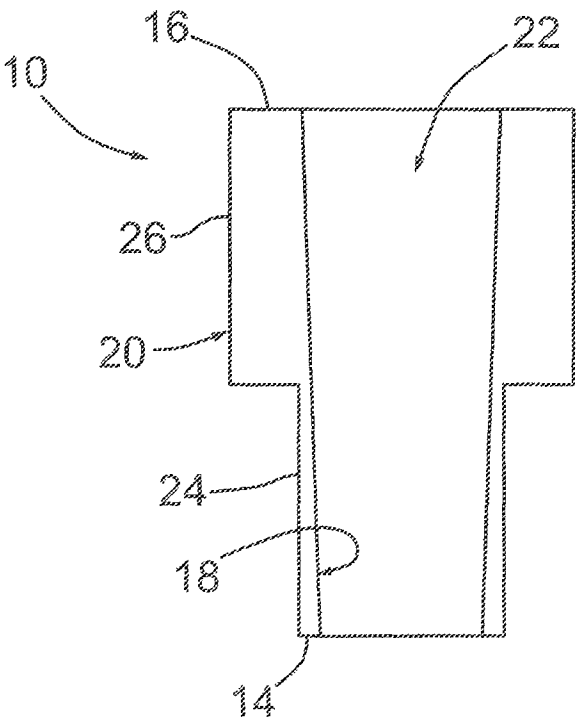
FIG. 5 is a cross sectional view along the line A-A in FIG. 1.

As shown in FIGS. 5 and 6, passageway 22 is tapered such that it increases in diameter from inner end 14 towards outer end 16. The interior diameter of inner end 14 in the present embodiment is less than the exterior diameter of ring 54, while the interior diameter of outer end 16 is greater than the exterior diameter of base portion 58.

As shown in FIG. 6, passageway 22 is dimensioned so as to sealingly engage injector nozzle 52 near inner end 14. The diameter of ring or seal 54 is larger than the interior diameter of inner end 14, such that when injector nozzle 52 is inserted into insert 10 through outer end 16, ring 54 and tip portion 56 are wedged within passageway 22 proximate to inner end 14. Ring 54 is wedged in place such that friction between ring 54 and corresponding interior surface 18 forms a tight seal therebetween. This seal helps to prevent blow-by between injector nozzle 52 and insert 10 during operation of the internal combustion engine.

It will be appreciated that the internal diameter of outer end 16 is larger than the diameter of base portion 58 of nozzle 52, meaning that the base is not in frictional contact with the corresponding portion of interior surface 18 encircling the base portion. As such, base portion 58 is unlikely to bond to interior surface 18. In these regards, the applicant found that in one particular embodiment of the invention, a taper of approximately 0.1 mm per 8.65 mm of length from outer end 16 to inner end 14 is effective in keeping base portion 58 from bonding to interior surface 18, thereby preventing material transfer from insert 10 to injector nozzle 52. It will be understood by one skilled in the art that other degrees of taper could be equally be utilized, including a taper of approximately 0.001 mm to 0.2 mm per 8.65 mm of length from outer end 16 to inner end 14.

Figure 7:
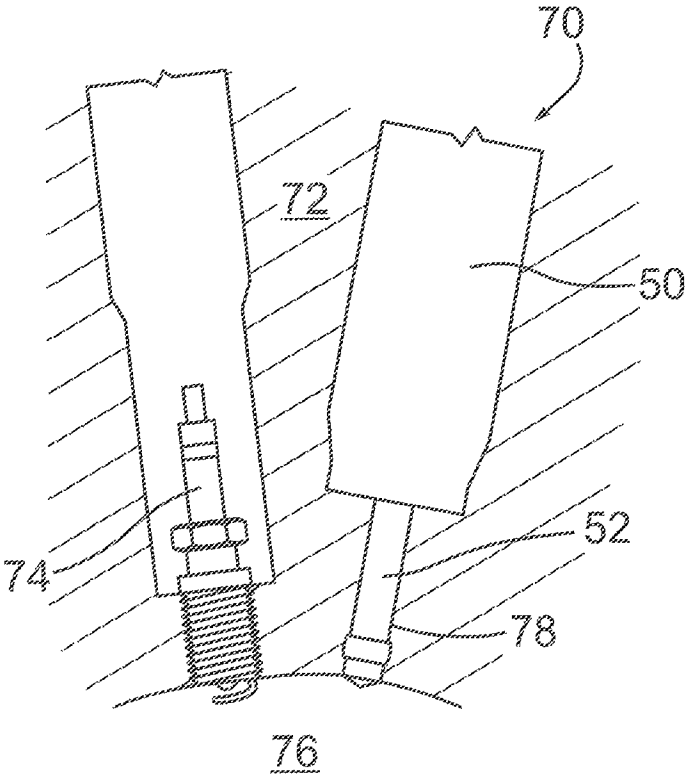
Fig. 7 (PRIOR ART)
FIG. 7 is a cross-sectional view of a portion of a cylinder head of a conventional direct fuel injection system.

FIG. 7 depicts a portion of a conventional direct fuel injection system 70 in an internal combustion engine (not shown) with fuel injector 50 and a spark plug 74 situated within a cylinder head 72. Fuel injector 50 delivers fuel to a combustion chamber 76 through injector nozzle 52. Cylinder head 72 has a bore 78 shaped to sealingly receive injector nozzle 52.

Figure 8:
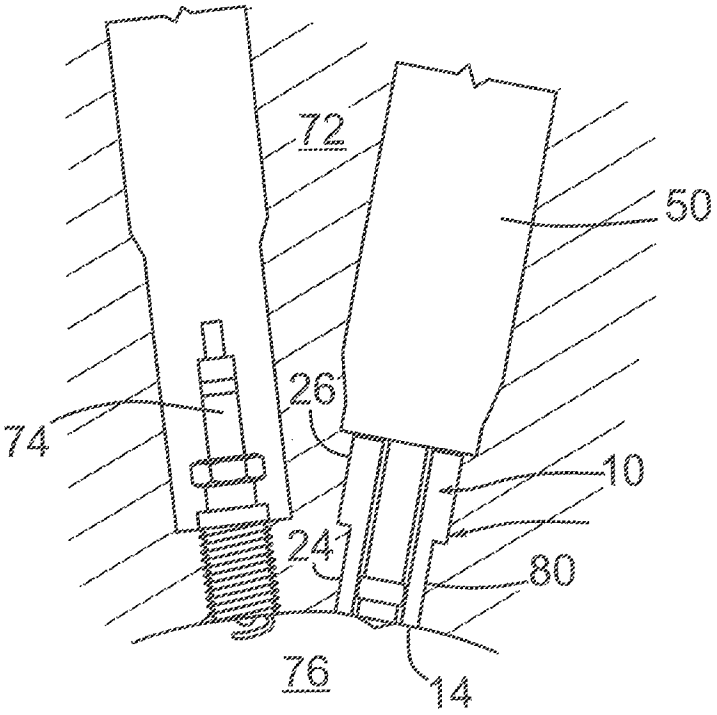
FIG. 8 is a view similar to FIG. 7 with the insert of FIG. 6 incorporated therein.

When insert 10 is in use with direct fuel injection system 70, cylinder head 72 will have an enlarged bore 80, which is configured to sealingly receive insert 10 within cylinder head 72. As shown in FIG. 8, where the insert has first and second portions 24 & 26, enlarged bore 80 will be of a complimentary configuration. Inner end 14 will be proximate to combustion chamber 76 when insert 10 is received within enlarged bore 80.

While there are a number of ways in which insert 10 can be sealed to cylinder head 72, the applicant has determined that use of an adhesive is effective in sealing exterior surface 20 of insert 10 within enlarged bore 80. In particular, the applicant has found the adhesive DuraBond™ 950, made by Cotronics Corp., to be effective for this particular purpose.

Insert 10 is preferably constructed from a material with thermodynamic properties generally similar to that of the cylinder head within which it is to be used. In this way, the thermal expansion and thermal contraction of insert 10 will be generally similar to that of the cylinder head. This helps to prevent shearing of the adhesive during operation of the internal combustion engine. To that end, the applicant has found that 7075 aircraft grade aluminum to be particularly effective when the insert is to be received within an aluminum head. It will be understood by one skilled in the art that other materials could also be used.

As noted earlier, because base portion 58 and interior surface 18 are not in frictional contact, it is less likely that base portion 58 will become bonded to interior surface 18. The likelihood that the removal of the injector will cause damage to either injector nozzle 52 and/or the cylinder head will thus be reduced.

Since base portion 58 is not in frictional contact with interior surface 18 when insert 10 is in use with fuel injector 50, less force will generally be required to remove injector nozzle 52 from insert 10, compared to the force required to conventionally remove injector nozzle 52 directly from bore 78. Accordingly, cleaning, repairing, or replacing the fuel injector tends to be simpler when insert 10 is used as described. Insert 10 may be used with existing fuel injectors while existing cylinder heads can be easily modified to incorporate the insert.

It is to be understood that what has been described are example embodiments of the invention. The scope of the claims should not be limited by the embodiments set forth above, but should be given the broadest interpretation consistent with the description as a whole.

I claim:

1. An insert for a cylinder head of an internal combustion engine, the cylinder head including a bore for receiving a fuel injector to deliver fuel through an injector nozzle into a combustion chamber of the engine, the insert comprising:

a generally tubular body having a longitudinally oriented passageway therethrough, receivable within the bore in the cylinder head and securable therein with an adhesive, the generally tubular body having an inner end and an outer end, said inner end in proximity to the combustion chamber when said insert is received within the bore, said passageway tapered such that the diameter of said passageway increases from said inner end toward said outer end, the longitudinal passageway dimensioned to sealingly receive the nozzle of the fuel injector when the fuel injector is received within the bore in the cylinder head, the insert limiting blow-by between the insert and the nozzle of the fuel injector during operation of the internal combustion engine, the tubular body formed from a material having thermodynamic properties generally the same as that of the cylinder head such that said insert and the cylinder head exhibit comparable degrees of thermal expansion and thermal contraction during operation of the internal combustion engine.

2. The insert as claimed in claim 1 wherein said longitudinally oriented passageway is circular in cross section.

3. The insert as claimed in claim 1 wherein the diameter of said longitudinally oriented passageway at said inner end is less than the exterior diameter of a circumferential sealing ring on the nozzle of the fuel injector, the diameter of said longitudinally oriented passageway at said outer end greater than the exterior diameter of an adjacent portion of the fuel injector nozzle when the fuel injector is received within the bore in the cylinder head.

4. The insert as claimed in claim 1 wherein the degree of taper of the longitudinal passageway within said insert, measured from said outer end to said inner end, is approximately 0.1 mm per 8.65 mm of length.

5. The insert as claimed in claim 1 wherein the degree of taper of the longitudinal passageway within said insert, measured from said outer end to said inner end, is from 0.001 mm to 0.2 mm per 8.65 mm of length.

6. The insert as claimed in claim 1 wherein the tubular body has an exterior surface, said exterior surface configured to be sealingly received in the bore, limiting blow-by between the insert and the cylinder head during operation of the internal combustion engine.

7. The insert as claimed in claim 6 wherein the exterior surface is stepped such that the diameter of the exterior surface of the tubular body increases in a direction from said inner end toward said outer end.

* * * * *